US012553296B2

(12) United States Patent
Yu et al.

(10) Patent No.: US 12,553,296 B2
(45) Date of Patent: Feb. 17, 2026

(54) DOWNHOLE HYDRAULIC MECHANICAL LOCK

(71) Applicant: Schlumberger Technology Corporation, Sugar Land, TX (US)

(72) Inventors: Leping Yu, Rosharon, TX (US); Weichen Lai, Rosharon, TX (US); Akhil Bahl, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/834,730

(22) PCT Filed: May 25, 2023

(86) PCT No.: PCT/US2023/023469

§ 371 (c)(1),
(2) Date: Jul. 31, 2024

(87) PCT Pub. No.: WO2023/230200

PCT Pub. Date: Nov. 30, 2023

(65) Prior Publication Data

US 2025/0154833 A1 May 15, 2025

Related U.S. Application Data

(60) Provisional application No. 63/365,293, filed on May 25, 2022.

(51) Int. Cl.
*E21B 17/06* (2006.01)

(52) U.S. Cl.
CPC ..... *E21B 17/06* (2013.01)

(58) Field of Classification Search
CPC ..... E21B 17/06
USPC ..... 166/244.1
See application file for complete search history.

(56) References Cited

U.S. PATENT DOCUMENTS 5,526,884 A * 6/1996 Lembcke ..... E21B 23/01 166/120
6,540,025 B2 4/2003 Scott
7,503,395 B2 3/2009 Meijer
7,806,190 B2 10/2010 Du
8,061,430 B2 11/2011 Du
(Continued)

FOREIGN PATENT DOCUMENTS

AU 2014413985 B2 5/2018
WO 2012151265 A2 11/2012

*Primary Examiner* — Taras P Bemko
(74) *Attorney, Agent, or Firm* — Jeffrey D. Frantz

(57) ABSTRACT

An improved downhole locking mechanism which may include a housing releasably connected to a downhole tool. The housing includes a first housing connected to a second housing. A sleeve disposed within the second housing. A coupling connecting the sleeve and a completion or another assembly. A piston disposed within the sleeve and retained in a locked position via a shear assembly. The piston maintains a retainer in the locked position, where the retainer engages both the sleeve and the lower housing. Hydraulic pressure within the bore of the locking mechanism causes the piston to shear the shear assembly and axially shift the piston towards the upper housing. Shifting the piston causes the retainer to move radially inward to an unlocked position and disengaging the sleeve from the lower housing and unlocking the locking mechanism.

20 Claims, 2 Drawing Sheets

(56) References Cited

U.S. PATENT DOCUMENTS

| | | | | |
|---|---|---|---|---|
| 9,303,484 | B2 * | 4/2016 | Storey | E21B 33/1285 |
| 9,371,703 | B2 | 6/2016 | Roane | |
| 9,995,090 | B2 * | 6/2018 | Allen | E21B 23/00 |
| 10,301,888 | B2 | 5/2019 | Richards | |
| 12,281,524 | B2 | 4/2025 | Lai | |
| 2004/0060710 | A1 * | 4/2004 | Marshall | E21B 29/005 166/381 |
| 2004/0216869 | A1 * | 11/2004 | Streater | E21B 23/0418 166/178 |
| 2012/0234560 | A1 * | 9/2012 | Ezell | E21B 23/01 166/382 |
| 2012/0279701 | A1 * | 11/2012 | Doane | E21B 33/1291 166/217 |
| 2013/0199799 | A1 * | 8/2013 | Phan | E21B 17/04 166/242.6 |
| 2022/0145711 | A1 * | 5/2022 | Schultz, Jr. | E21B 23/0421 |
| 2024/0287857 | A1 | 8/2024 | Yu | |

* cited by examiner

DOWNHOLE HYDRAULIC MECHANICAL LOCK

CROSS-REFERENCE TO RELATED APPLICATION

The present document National Stage Entry of International Application No. PCT/US2023/023469, filed May 25, 2023, which is based on and claims priority to U.S. Provisional Application Ser. No. 63/365,293, filed May 25, 2022, which is incorporated herein by reference in its entirety.

BACKGROUND

In a variety of well-related operations, downhole tools are utilized to carry out desired tasks at downhole locations. For example, different types of downhole tools may be utilized to drill wellbores, deploy tubing and other equipment downhole, perform testing operations, and conduct servicing operations, among other possibilities. During these operations, a downhole tool is connected to another tool. When the operation is completed, the downhole tool may need to be unlocked or released from the downhole completion.

SUMMARY

A system and method for performing a downhole operation, including unlocking a locking mechanism. The locking mechanism locks a tool in place and prevents premature action. The locking mechanism is shifted to an unlocked position by applying a pressure within a bore of the locking mechanism. Advantages and other features of the invention will become apparent from the following description, drawings, and claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
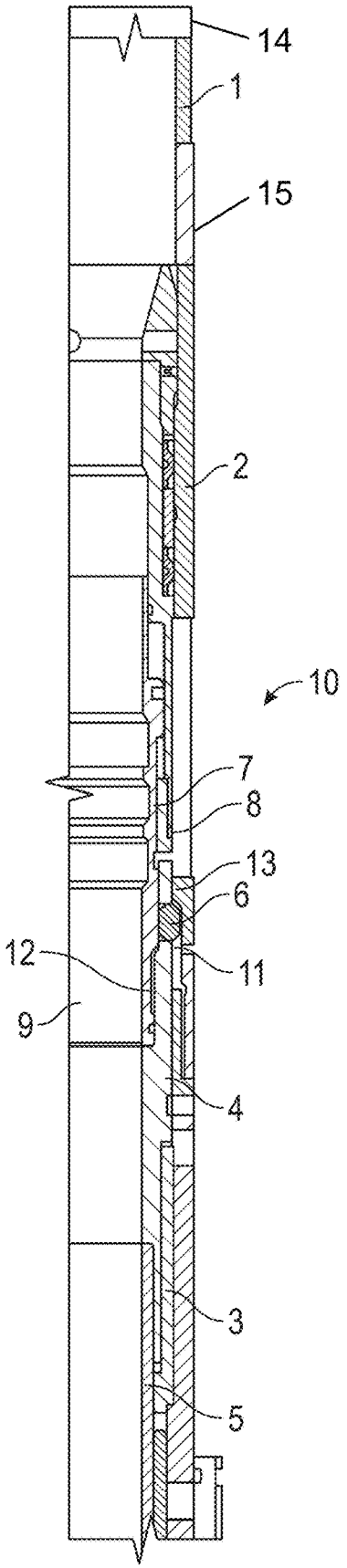
FIG. 1 is a cross-sectional diagram of a locking mechanism in a locked position according to an embodiment of the disclosure.

Turning now to FIG. 1, FIG. 1 is a portion of a cross section of a locking mechanism 10 for use on a downhole tubular, e.g., a completion string, in a locked position in accordance with one or more embodiments. The locking mechanism locks a tool in place and prevents premature action. The locking mechanism 10 includes an upper housing 1 that may be coupled to the downhole tubular 14, a lower housing 2 coupled (e.g., via coupling 15) to the upper housing 1, a transfer ring 3 disposed within the lower housing 2, a sleeve 4 disposed within the lower housing 2 and adjacent to the transfer ring 3, and a coupling 5 that is coupled at a first end to the sleeve 4. One or more retainers 6 are radially movable within one or more recesses 11 in the sleeve 4. A second end of the coupling 5 may be coupled to a completion or another assembly of the downhole tubular. A piston 7 is disposed within the sleeve 4 and retained in a locked position via a shear assembly 8, e.g., a shear screw. The piston 7 may comprise a plurality of seals located about the circumference of the piston 7 and are oriented to form a sealing engagement. The piston 7 has one or more retention recesses 12 on the outer surface of the piston 7. The piston 7 maintains the position of the one or more retainers 6 in the locked position, when the one or more retainers 6 engages both the sleeve 4 and a compression bevel 13 of the lower housing 2.

While the locking mechanism 10 is in the locked position, as shown in FIG. 1, tension force applied to the upper housing 1 will transfer through the lower housing 2 to the coupling 5 via transfer ring 3 and the sleeve 4 without shearing the shear assembly 8. Similarly, compressive force applied to the upper housing 1 will transfer through the lower housing 2 to the coupling 5 via the one or more retainers 6 and the sleeve 4 without shearing the shear assembly 8. By not shearing the shear assembly 8 via application of a tension force or a compressive force to the upper housing 1, the piston 7 retains the one or more retainers 6 in the locked position until the piston 7 is released, as described in more detail below, thereby preventing relative movement between the lower housing 2 and the sleeve 4 when a compressive load is applied to the upper housing 1.

Figure 2:
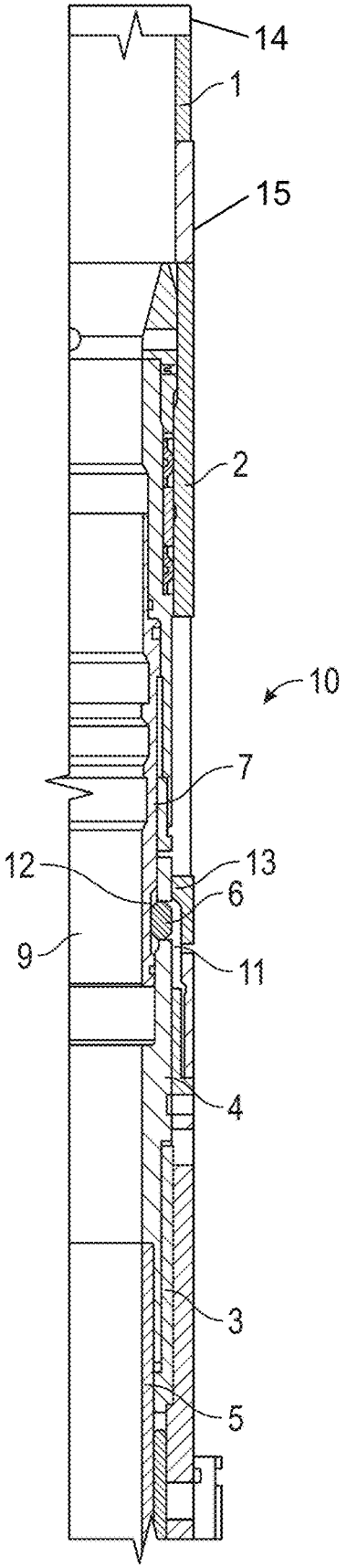
FIG. 2 is a cross-sectional diagram of the locking mechanism of FIG. 1 in an unlocked position.

Turning now to FIG. 2, FIG. 2 shows the locking mechanism 10 in an unlocked position. The locking mechanism 10 is shifted to the unlocked position by applying a pressure within the bore 9 of the locking mechanism 10. The hydraulic pressure within the bore 9 of the locking mechanism 10 causes the piston 7 to shear the shear assembly 8 and axially shift towards the upper housing 1. In some embodiments, a shifting tool (not shown) may be used to shear the shear assembly 8 and shift the piston 7, in addition to or in place of applying hydraulic pressure to the piston 7. Further, other embodiments of the locking mechanism 10 may axially shift the piston 7 towards the coupling 5 to unlock the locking mechanism 10. In other embodiments, a collet (not shown) can be incorporated into the piston 7 to prevent moving after shifting of the piston.

Shifting the piston 7 will align the one or more retention recesses 12 with the one or more retainers 6. The one or more retainers 6 will move radially inward due to the compressive force applied to the lower housing 2. The compression bevel 13 of the lower housing 2 contacts the one or more retainers 6 and when the compressive force applied to the upper housing 1 transferred through the lower housing 2 will cause the one or more retainers 6 will move radially inward into the one or more retention recesses 12. Additionally, the compressive force applied to the upper housing 1 transferred through the lower housing 2 will cause relative axial movement between the lower housing 2 and the sleeve 4. This relative axial movement may be utilized to shift or otherwise actuate a downhole tool (not shown) coupled to the lower housing 2. Radially shifting the one or more retainers 6 inwardly causes the locking mechanism 10 to be in on unlocked position.

Shifting the piston 7 causes the one or more retainers 6 align with the one or more retention recesses 12. A compressive force is applied to disengaging the sleeve 4 from the lower housing 2 and unlocking the locking mechanism 10. Once the locking mechanism 10 is unlocked, the compressive force applied to the upper housing 1 will cause relative axial movement between the lower housing 2 and the sleeve 4.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A locking mechanism for use with a tubular positionable in a wellbore, the locking mechanism comprising:

an upper housing couplable to the tubular;

a lower housing coupled to the upper housing;

a transfer ring disposed within the lower housing;

a sleeve disposed within the lower housing and adjacent to the transfer ring;

a coupling coupled at a first end to the sleeve;

a piston disposed within the sleeve and retained in position via a shear assembly, wherein the piston comprises an outer surface having a first portion axially offset from a second portion, and the second portion comprises a retention recess extending radially into the outer surface relative to the first portion; and a retainer retained in a locked position via engagement with the first portion of the piston to prevent relative axial movement of the lower housing and the sleeve when a compressive load is applied to the upper housing, wherein the retainer is configured to change from the locked position to an unlocked position in response to shifting the retainer axially from the first portion to the second portion of the piston and moving radially into the retention recess of the piston.

2. The locking mechanism of claim 1, wherein the retainer is disposed in a recess in the sleeve, and the retainer is configured to move radially through the recess in the sleeve between an inner surface of the lower housing and the retention recess in the piston.

3. The locking mechanism of claim 1, wherein the lower housing has a compression bevel along an inner surface of the lower housing, and the compression bevel is configured to drive the retainer to move radially into the retention recess of the piston in response to axial movement between the piston and the lower housing.

4. The locking mechanism of claim 1, wherein the piston is configured to shift in response to shearing of the shear assembly.

5. The locking mechanism of claim 4, wherein a hydraulic pressure within a bore of the locking mechanism will shear the shear assembly.

6. The locking mechanism of claim 1, wherein the sleeve extends over the retention recess of the piston in the locked position of the retainer, and the sleeve at least partially uncovers the retention recess of the piston in the unlocked position of the retainer.

7. The locking mechanism of claim 1, wherein the locked position of the retainer has the retainer held radially between the first portion of the piston and an inner surface of the lower housing, and held axially between the sleeve and a compression bevel along the inner surface of the lower housing.

8. A system for utilizing a hydraulic lock comprises a locking mechanism coupled to a downhole tubular;

wherein a retainer retains the locking mechanism in a locked position and prevents axial movement between a lower housing of the locking mechanism and a sleeve of the locking mechanism;

wherein a piston is disposed within an inner surface of the sleeve and retained in position via a shear assembly;

wherein the retainer is radially movable within a recess in the sleeve;

wherein shifting the piston will align a retention recess on an outer surface of the piston with the retainer;

wherein the lower housing has a compression bevel, wherein in response to a compressive force applied to the lower housing, the compression bevel of the lower housing will push the retainer radially inward; and wherein the compressive force applied to the lower housing disengages the sleeve from the lower housing and unlocks the locking mechanism.

9. The system of claim 8, wherein the piston is configured to shift in response to shearing of the shear assembly.

10. The system of claim 9, wherein a hydraulic pressure is configured to cause the shearing of the shear assembly.

11. The system of claim 9, wherein the piston is configured to shift in response to a hydraulic pressure and the shearing of the shear assembly.

12. The system of claim 8, wherein the sleeve extends over the retention recess of the piston in the locked position of the locking mechanism, the sleeve at least partially uncovers the retention recess of the piston in an unlocked position of the locking mechanism, the locked position has the retainer held radially between the outer surface of the piston and an inner surface of the lower housing, and the locked position has the retainer held axially between the sleeve and the compression bevel along the inner surface of the lower housing.

13. A method comprising:

retaining a retainer of a locking mechanism in a locked position via engagement with a first portion of a piston to prevent relative axial movement between a lower housing of the locking mechanism and a sleeve of the locking mechanism, wherein the piston comprises an outer surface having the first portion axially offset from a second portion, and the second portion comprises a retention recess extending radially into the outer surface relative to the first portion;

shifting the piston via a pressure applied within a bore of the locking mechanism to shift the retainer axially from the first portion to the second portion of the piston;

applying a compressive force to an upper housing of the locking mechanism to shift the retainer radially inward to an unlocked position within the retention recess in the second portion of the piston; and the applied compressive force to the upper housing causes the relative axial movement between the lower housing and the sleeve of the locking mechanism and actuate a downhole tool coupled to the locking mechanism.

14. The method of claim 13, further comprises shearing a shear assembly to unlock the piston and enable shifting the piston.

15. The method of claim 14, wherein shearing the shear assembly comprises shearing the shear assembly in response to the applied pressure within the bore of the locking mechanism.

16. The method of claim 13, further comprises the compressive force applied to the upper housing will transfer to the lower housing.

17. The method of claim 13, further comprises the retainer is disposed in a recess in the sleeve when the compressive force is applied causing a compression bevel of the lower housing to push the retainer radially inward into the retention recess in the second portion of the piston.

18. The method of claim 17, wherein the retainer is configured to move radially through the recess in the sleeve between an inner surface of the lower housing and the retention recess in the piston.

19. The method of claim 13, wherein the sleeve extends over the retention recess of the piston in the locked position of the retainer, and the sleeve at least partially uncovers the retention recess of the piston in the unlocked position of the retainer.

20. The method of claim 19, wherein the locked position of the retainer has the retainer held radially between the first portion of the piston and an inner surface of the lower housing, and held axially between the sleeve and a compression bevel along the inner surface of the lower housing.

* * * * *